US006119642A

United States Patent [19]

Harrell

[11] Patent Number: 6,119,642

[45] Date of Patent: Sep. 19, 2000

[54] CAM FOLLOWER CONFIGURED AS A ROCKER ARM OR A FINGER LEVER FOR A VALVE TRAIN OF AN INTERNAL COMBUSTION ENGINE

[75] Inventor: Alicia M. Harrell, Fort Mill, S.C.

[73] Assignee: INA Walzlager Schaeffler OHG, Herzogenaurach, Germany

[21] Appl. No.: 09/285,433

[22] Filed: Apr. 2, 1999

Related U.S. Application Data

[60] Provisional application No. 60/086,425, May 22, 1998.

[51] Int. Cl.[7] ..... F01L 1/18

[52] U.S. Cl. ..... 123/90.41; 123/90.51; 74/559

[58] Field of Search ..... 123/90.39, 90.41, 123/90.42, 90.43, 90.44, 90.51; 74/519, 559

[56] References Cited

U.S. PATENT DOCUMENTS 5,123,384 6/1992 Abbas ..... 123/90.39
5,313,916 5/1994 Murphy ..... 123/90.39
5,329,891 7/1994 Murphy et al. ..... 123/90.39
5,433,178 7/1995 Urmaza ..... 123/90.41
5,437,209 8/1995 Santoro ..... 74/559
5,560,265 10/1996 Miller ..... 74/559

*Primary Examiner*—Weilun Lo
*Attorney, Agent, or Firm*—Volpe and Koenig, P.C.

[57] ABSTRACT

A cam follower is provided having a thin-walled ring fixed in the bore of the shaft to extend across a parting plane between the shaft and the support. The ring includes a radially inwardly directed collar having a bore or an internal thread which is mated to a corresponding thread of a threaded fastener. Due to the fact that the collar or the internal thread is arranged in the region of an edge of the securing ring remote from the cylinder head, the threaded fastener has an adequate axial mobility in the pre-assembled state. This freedom of movement enables excellent handling during final assembly.

11 Claims, 1 Drawing Sheet

CAM FOLLOWER CONFIGURED AS A ROCKER ARM OR A FINGER LEVER FOR A VALVE TRAIN OF AN INTERNAL COMBUSTION ENGINE

CROSS REFERENCE TO RELATED APPLICATIONS

This application claims the benefit of U.S. Provisional Application Ser. No. 60/086,425, filed May 22, 1998.

BACKGROUND OF THE INVENTION

The invention concerns a cam follower configured as a rocker arm or a finger lever for a valve train of an internal combustion engine, said cam follower presenting the following features:

a) the cam follower is comprised of two longitudinally extending side walls which are connected by a crossbar and enclose an intermediate space;

b) the side walls possess two aligned receptions for lodging a shaft about which the cam follower is pivotable;

c) the shaft is adapted to be connected or is connected to at least one support extending vertically of a longitudinal extent of the shaft, by which support the shaft can be positioned or is positioned on a cylinder head of an internal combustion engine, each of the shaft and the support comprising a bore extending therethrough; and d) a screw means by which the cam follower can be fixed or is fixed on the cylinder head can be inserted or is inserted through the bore of the shaft and the bore of the support.

A cam follower of the pre-cited type known from U.S. Pat. No. 5,329,891 likewise comprises a screw means which is inserted through bores of the shaft of the cam follower and of the support and is screwed into a cylinder head. This fixes the entire cam follower in place on the cylinder head.

A drawback of the aforesaid cam follower is that it cannot be delivered in a fully pre-assembled state because it is possible for the screw means to fall out of the bore of the shaft during transportation and handling until the final fixing of the cam follower on the cylinder head. If, in addition, the cam follower is required to be delivered together with the support, a person skilled in the art finds no suggestion in the cited document as to how the support and the other components of the cam follower can be retained together until final mounting. Thus, work and time involved in the mounting of the prior art cam follower are unnecessarily increased, and this results in a disadvantageous increase of the total costs.

OBJECTS OF THE INVENTION

It is an object of the invention to provide an improved cam follower of the pre-cited type in which the mentioned drawbacks are eliminated and a falling-apart of the cam follower is prevented with the help of simple means, from the pre-assembled state till final installation.

This and other objects and advantages of the invention will become obvious from the following detailed description.

SUMMARY OF THE INVENTION

In the improved cam follower of the invention a thin-walled ring is fixed in the bore of the shaft, or simultaneously in the bore of the shaft and the bore of the support, to extend across a parting plane between the shaft and the support, and said ring comprises, preferably in the region of an edge thereof remote from the cylinder head, a radially inwards directed collar having a bore or an internal thread, which bore or internal thread is mated to a thread of the screw means.

In this way, a retention device with a simple structure is created to prevent a dislodging of the pre-assembled screw means from the cam follower. If the support is also required to be delivered in a pre-assembled state with the cam follower, it can likewise be secured in a simple manner by the measures of the invention. The scope of protection of the present invention also covers solutions in which the screw means does not have to be pre-assembled but, rather, only the support is required to be secured against loss on the shaft of the cam follower.

Due to the fact that the collar or the internal thread is arranged in the region of an edge of the securing ring remote from the cylinder head, the screw means has an adequate axial mobility in the pre-assembled state. This freedom of movement enables excellent handling during final assembly.

It is also conceivable to arrange the bore of the shaft exteriorly of the cam follower, in which case it is advantageous to have the shaft project outwardly from both side walls and arrange a bore in each projecting portion of the shaft. However, it is normally more appropriate to arrange the bore of the shaft between the side walls.

The cam follower of the invention can be made of sheet metal, cast, or other suitable material.

According to a further feature of the invention, the screw means comprises a shank having a smaller diameter than the bore of the collar or the internal thread so that a particularly high degree of axial mobility of the screw means is assured. The clamping of the cam follower on the cylinder head is effected with the help of the enlarged head of the screw.

The inwards directed collar of the ring may extend over the entire circumference of the ring or, alternatively, be made with a single turn of a thread. According to another embodiment, the collar can be made as an elastic lip so that it is deformed by the thread of the screw means during the mounting of the screw means and regains its original shape when the shank region passes through. It is also possible to provide segment-shaped recesses in the collar. This enables a particularly easy mounting of the screw means.

Further, the ring of the invention may be made optionally of a metal or a light-weight material such as plastic. The ring can be fixed in a simple manner in the bore or bores by a press fit, but it is also conceivable to fix it by other means such as gluing, snapping, stamping and the like.

In an alternative embodiment of the invention, the shaft is guided in the receptions of the side walls on a rolling bearing, such as a needle roller bearing, arranged in each reception. This enables a particularly low-friction pivoting of the cam follower.

According to a further feature of the invention, the shaft and the support are made as two separate parts. However, a one-piece configuration of the support and shaft is conceivable.

DETAILED DESCRIPTION OF THE INVENTION

Figure 1:
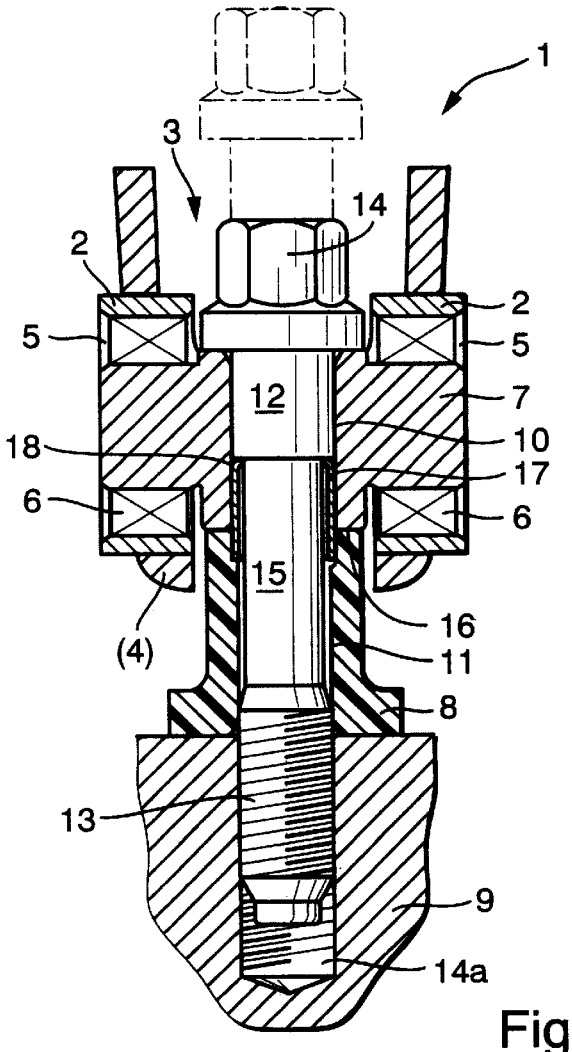
FIG. 1 is a cross-section through a cam follower of the invention taken in the region of its shaft in the screwed-in state.

FIG. 1 shows a cam follower 1 configured as a rocker arm comprising two longitudinally extending side walls 2 which enclose an intermediate space 3. The side walls 2 are connected to each other at their bottom portions by a crossbar 4. At one end, not shown, the cam follower 1 acts through a bottom of the crossbar 4 on a gas exchange valve, not shown, while its second end is engaged, for instance, by a tappet push rod.

Two aligned receptions 5 extend through the side walls 2 approximately in the region of a central transverse plane. A shaft 7 is positioned in these receptions 5 by a rolling bearing 6 arranged in each reception 5. The cam follower 1 is thus pivotable about a longitudinal axis of the shaft 7. In the region of its bottom, the shaft 7 is provided with a support 8 extending vertically thereof. The support 8 supports the shaft 7 on a cylinder head 9 of the internal combustion engine. In the region of the intermediate space 3, the shaft 7 comprises a through-bore 10 which is aligned to a further bore 11 arranged in the support 8. A screw means 12 is inserted through these bores 10, 11 and screwed by its thread 13 into a bore 14*a* of the cylinder head 9. The clamping action of the screw means 12 is produced by the fact that the head 14 of the screw means 12 has a larger diameter than the bore 10 and thus extends on the shaft 7.

The thread 13 is provided only in a region of the screw means 12 remote from the head 14 of the screw means 12, and the thread 13 merges in a direction towards the head 14 into a shank 15 having a smaller diameter than the thread 13.

Figure 3:
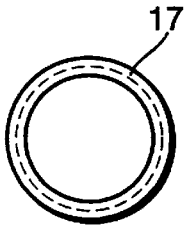
FIGS. 3 to 5 are special views of the ring of the invention.
Figure 4:
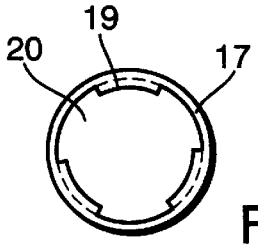
Figure 5:
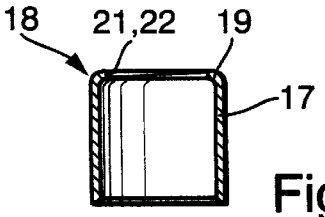

At the same time, a ring 17 is arranged in the bores 10 and 11 to extend across a parting plane 16 between the shaft 7 and the support 8. The ring 17 is thin-walled and fixed in the bores 10, 11 by a press fit. As can be seen more clearly in FIGS. 3 to 5, a radially inwards bent collar 19 is arranged in the region of an edge 18 of the ring 17 remote from the cylinder head 9. The collar 19 can extend over the entire circumference of the ring as shown in FIG. 3 or comprise recesses 20 as shown in FIG. 4. The collar 19 can also comprise one turn of an internal thread 21, or a bore of the ring 17 can comprise an internal thread. A bore 22 of the collar 19 or its internal thread 21, as the case may be, is mated to the thread 13 of the screw means 12. However, it is also possible, especially in the case of the ring 17 of FIG. 4 comprising recesses 20, to make the remaining collar sections as elastic lips.

The elastic lips can be formed to an angle such that clearance is allowed for the threaded portion of the screw means 12 to enter the ring 17 until the head 14 of the screw means 12 encounters the lips, at least indirectly, and flanges them such that the screw means 12 is retained. It is also conceivable that a separate tool flanges the lips over prior to pressing into the shaft 7 and after the screw means 12 is in the ring 17.

The ring 17 constitutes an excellent retention device for the transportation and mounting of the entire cam follower 1 when the cam follower 1 is to be delivered with a pre-assembled screw means 12. The screw means 12 is screwed with its thread 13 through the collar 19 of the ring 17 and, at the same time, possesses an adequate axial mobility relative to the collar 19 through its shank 15. The screw means 12 is effectively prevented from falling out of the bores 10, 11. FIG. 1 further shows that the support 8 is fixed on the shaft 7 by the ring 17. Thus it is also conceivable to create a sub-assembly consisting only of the shaft 7 and the support 8 fixed to each other by the ring 17.

Figure 2:
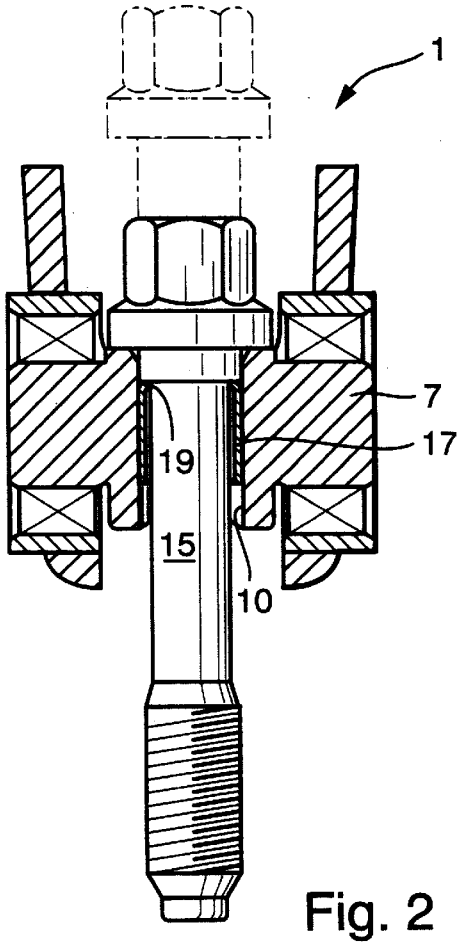
FIG. 2 is similar to FIG. 1 but shows an alternative embodiment of the cam follower of the invention.

An alternative embodiment to FIG. 1 is disclosed in FIG. 2. In this case, the ring 17 is arranged only in the bore 10 of the shaft 7 and thus secures only the screw means 12 to the shaft 7. It is understood that the screw means 12 does not necessarily have to be made in one piece with its head 14. It is possible to provide a separate head 14 and screw it onto an end of a threaded portion of the screw means 12.

If the configuration of the ring 17 shown in FIG. 4 is preferred, all that has to be done for mounting the screw means 12 is to elastically deform the segmental collar 19 with the thread 13 of the screw means 12 to the extent that permits the screw means 12 to be inserted axially through the ring 17.

What I claim is:

1. A cam follower (1) configured as a rocker arm or a finger lever for a valve train of an internal combustion engine, said cam follower (1) presenting following features:

a) the cam follower (1) is comprised of two longitudinally extending side walls (2) which are connected by a crossbar (4) and enclose an intermediate space (3);

b) the side walls (2) possess two aligned receptions (5) for lodging a shaft (7) about which the cam follower (1) is pivotable;

c) the shaft (7) is adapted to be connected or is connected to at least one support (8) extending vertically of a longitudinal extent of the shaft (7), by which support (8) the shaft (7) can be positioned or is positioned on a cylinder head (9) of an internal combustion engine, each of the shaft (7) and the support (8) comprising a bore (10, 11) extending therethrough; and d) a screw means (12) by which the cam follower (1) can be fixed or is fixed on the cylinder head (9) can be inserted or is inserted through the bore (10) of the shaft (7) and the bore (11) of the support (8), characterized in that e) a thin-walled ring (17) is fixed in the bore (10) of the shaft (7), or simultaneously in the bore (10) of the shaft (7) and the bore (11) of the support (8), to extend across a parting plane (16) between the shaft (7) and the support (8), and f) said ring (17) comprises, a radially inwards directed collar (19) having a bore (22) or an internal thread (21), which bore (22) or which internal thread (21) is mated to a thread (13) of the screw means (12).

2. A cam follower of claim 1 wherein the thread (13) is provided only on an end of the screw means (12) remote from a head (14) of the screw means (12), said thread (13) merges into a shank (15) which has a smaller diameter than the bore (22) of the collar (19) or the internal thread (21), the head (14) of the screw means (12) having a larger diameter than the bore (10) of the shaft (7).

3. A cam follower of claim 1 wherein the collar (19) is made as an elastic lip or comprises at least one segment-shaped recess (20).

4. A cam follower of claim 1 wherein the ring (17) is made of metal or of a light-weight material including plastic.

5. A cam follower of claim 1 wherein the internal thread (21) comprises only one turn.

6. A cam follower of claim 1 wherein the shaft (7) is guided in the receptions (5) of the side walls (2) on a rolling bearing (6), including a needle rolling bearing, arranged in each reception (5).

7. A cam follower of claim 1 made of steel sheet.

8. A cam follower of claim 1 wherein the bore (10) of the shaft (7) is positioned in a region of the intermediate space (3).

9. A cam follower of claim 1 wherein the shaft (7) and the support (8) are made as two separate parts.

10. A cam follower of claim 1 wherein the ring (17) is fixed in the bore (10) of the shaft (7), or simultaneously in the bore (10) of the shaft (7) and in the bore (11) of the support (8), by a press fit.

11. A cam follower of claim 1 wherein the radially inwards directed collar (19) is located in a region of an edge (18) of the ring (17) remote from the cylinder head (9).

* * * * *